US007988147B2

(12) United States Patent
Ito

(10) Patent No.: US 7,988,147 B2
(45) Date of Patent: Aug. 2, 2011

(54) SHEET CONVEYING APPARATUS

(75) Inventor: Shinichi Ito, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 18 days.

(21) Appl. No.: 12/202,693

(22) Filed: Sep. 2, 2008

(65) Prior Publication Data

US 2009/0166959 A1 Jul. 2, 2009

(30) Foreign Application Priority Data

Dec. 27, 2007 (JP) ..... 2007-337803

(51) Int. Cl.
*B65H 5/00* (2006.01)

(52) U.S. Cl. ..... 271/225; 271/184

(58) Field of Classification Search ..... 271/225, 271/314, 272–274, 184, 185
See application file for complete search history.

(56) References Cited

U.S. PATENT DOCUMENTS

| | | | | | |
|---|---|---|---|---|---|
| 4,119,194 | A | * | 10/1978 | Freeman et al. | 198/400 |
| 4,299,379 | A | * | 11/1981 | Preston et al. | 271/3.01 |
| 5,109,987 | A | * | 5/1992 | Daboub et al. | 209/657 |
| 5,429,249 | A | * | 7/1995 | Belec et al. | 209/584 |
| 6,405,930 | B1 | * | 6/2002 | Kubert | 235/487 |
| 6,481,712 | B1 | * | 11/2002 | Yap | 271/303 |
| 6,688,593 | B1 | * | 2/2004 | Auerbach | 209/584 |

FOREIGN PATENT DOCUMENTS

| | | | |
|---|---|---|---|
| JP | 63-74846 | * | 4/1988 |
| JP | 09-155297 | | 6/1997 |
| KR | 2006-0112655 | | 11/2006 |
| WO | WO 2006/110486 | | 10/2006 |

OTHER PUBLICATIONS

Korean Office Action dated Feb. 4, 2010 for Appln. No. 10-2008-86839.
Korean Office Action dated Nov. 12, 2010.

* cited by examiner

*Primary Examiner* — Stefano Karmis
*Assistant Examiner* — Thomas A Morrison
(74) *Attorney, Agent, or Firm* — Pillsbury Winthrop Shaw Pittman, LLP

(57) ABSTRACT

A sheet conveying apparatus for OCR/VSC integrated systems, which selectively delivers postal items to upper- and lower-side stackers, includes at least one pair of conveyor belts bifurcating from a bifurcation gate to the down-side stackers, and at least one pair of conveyor belts bifurcating from the bifurcation gate to the upper-side stackers. The conveyor belts include a first twisted section, an S-shaped ascending portion, and a second twisted portion. Each postal item is tilted by the first twisted portion, then raised by the S-shaped ascending portion with its tilted attitude maintained, and returned to upright by the second twisted portion.

5 Claims, 4 Drawing Sheets

SHEET CONVEYING APPARATUS

CROSS-REFERENCE TO RELATED APPLICATIONS

This application is based upon and claims the benefit of priority from prior Japanese Patent Application No. 2007-337803, filed Dec. 27, 2007, the entire contents of which are incorporated herein by reference.

BACKGROUND OF THE INVENTION

1. Field of the Invention

The present invention relates to a sheet conveying apparatus for delivering upright sheets of paper to paths of different levels.

2. Description of the Related Art

There is known a sheet conveying apparatus for delivering, into stackers corresponding to addresses, postal items from which data expressed as postal codes and indicating the addresses has already been read. OCR/VSC integrated systems incorporating the conveying apparatus generally need several tens or more of stackers for delivering postal items. To this end, in the OCR/VSC integrated systems, a large number of stackers are stacked in several stages.

More specifically, a conveyor apparatus for use in general OCR/VSC integrated systems is designed to deliver postal items having their address information already read to paths of different levels, and then into designated stackers in each stage. When delivering postal items to paths of different levels, it is technically difficult to deliver upright postal items with their attitudes unchanged. Therefore, in general, postal items conveyed flat are delivered to paths of different levels.

Jpn. Pat. Appln. KOKAI Publication No. 9-155297, for example, discloses a conveyor apparatus for OCR/VSC integrated systems, in which postal items are delivered flat to a plurality of paths of different levels with their conveyance attitude unchanged, and then are twisted through 90° into an upright attitude and collected into stackers.

If postal items are horizontally stacked on each other in each stacker, operators may well cause the postal items to fall apart to pieces when they-remove them from each stacker. To avoid this, in the disclosed apparatus, the postal items are conveyed flat, and are brought upright when they are collected into each stacker, which facilitates removal by operators.

However, in the above-described apparatus, postal items delivered flat to paths of different levels are abruptly rotated through 90° over a relatively short distance. Therefore, the conveyance attitude of each postal item is liable to be off balance. Where postal items are twisted while being conveyed by a pair of conveyor belts, if, in particular, they are heavy, a great centrifugal force will be exerted on them when their attitude is changed from flat to upright. As a result, the postal items may well be ejected from between the two conveyor belts.

BRIEF SUMMARY OF THE INVENTION

It is an object of the invention to provide a sheet conveyor apparatus capable of delivering upright paper sheets to paths of different levels without degrading the conveyance attitude of each sheet.

To attain the object, a sheet conveying apparatus according to an embodiment of the invention comprises: a first conveyor section configured to convey paper sheets upright on a first path of a first level; a second conveyor section configured to tilt the paper sheets conveyed upright, and to convey the tilted paper sheets with a conveyance direction thereof shifted, thereby guiding the tilted paper sheets to a second path of a second level; and a third conveyor section configured to convey the tilted paper sheets with an attitude thereof returned to upright.

In the invention constructed as above, paper sheets conveyed upright on a first path of a first level are tilted, then conveyed with their conveyance direction shifted, and guided to a second path of a second level. After that, the conveyance attitude of the paper sheets is returned to upright. By virtue of this structure, the paper sheets can be conveyed from the first level to the second level without degrading the conveyance attitude. In particular, since the paper sheets are tilted by less than 90° when they are conveyed twisted, the stress occurring in the paper sheets during the twisting conveyance can be minimized, thereby suppressing degradation of the conveyance attitude of the paper sheets.

A sheet conveying apparatus according to the embodiment of the invention comprises: a substantially horizontal first reference surface with which lower edges of paper sheets conveyed upright are kept in contact; a second reference surface continuously extending from the first reference surface and tilted therefrom; a third reference surface continuously extending from the second reference surface substantially parallel to the first reference surface positioned at a level different from a level of the first reference surface; and at least one pair of conveyor belts extending substantially perpendicular to the first to third reference surfaces, the conveyor belts holding the paper sheets therebetween and permitting the lower edges of the paper sheets to be kept in contact with the first to third reference surfaces while running to convey the paper sheets, the conveyor belts enabling a conveyance attitude of the paper sheets to be varied during conveyance thereof.

In the invention constructed as above, the paper sheets conveyed upright on the first reference surface are tilted using the second reference surface that are tilted with respect to the first reference surface, and are then conveyed on the third reference surface that is substantially parallel to the first reference surface and is positioned at a level different from that of the first reference surface, whereby the conveyance attitude of the paper sheets is returned to upright. Thus, the paper sheets can be conveyed upright to a different level. In particular, since the paper sheets are tilted by less than 90° when they are conveyed twisted, i.e., since the tilt angle of the second reference surface with respect to the first reference surface is set to less than 90°, the stress occurring in the paper sheets during the twisting conveyance can be minimized, thereby suppressing degradation of the conveyance attitude of the paper sheets.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

Figure 2:
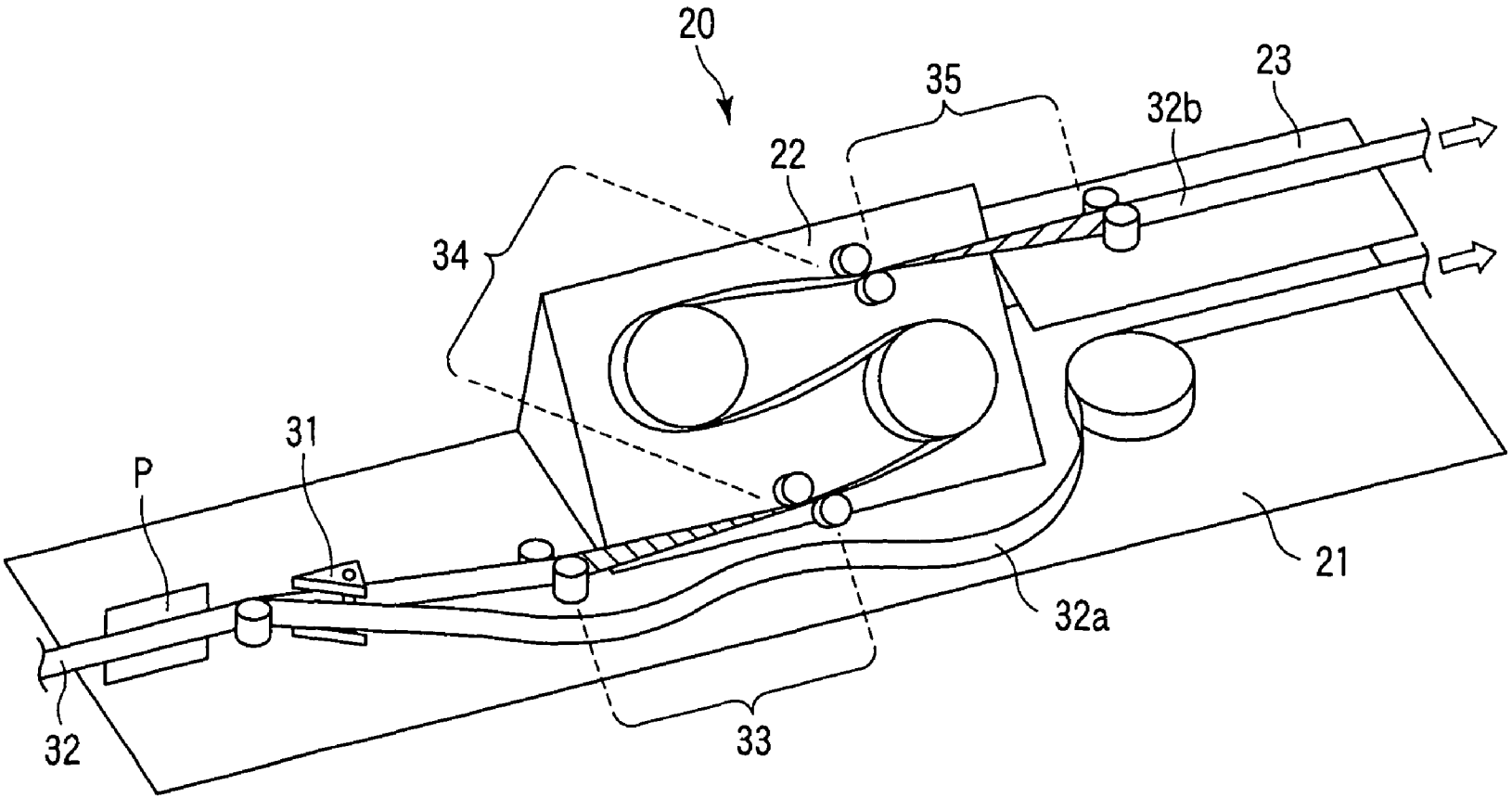
FIG. 2 is a schematic perspective view illustrating the structure of the sorter/conveyor apparatus provided at the bifurcation section of the OVIS shown in FIG. 1.
Figure 3:
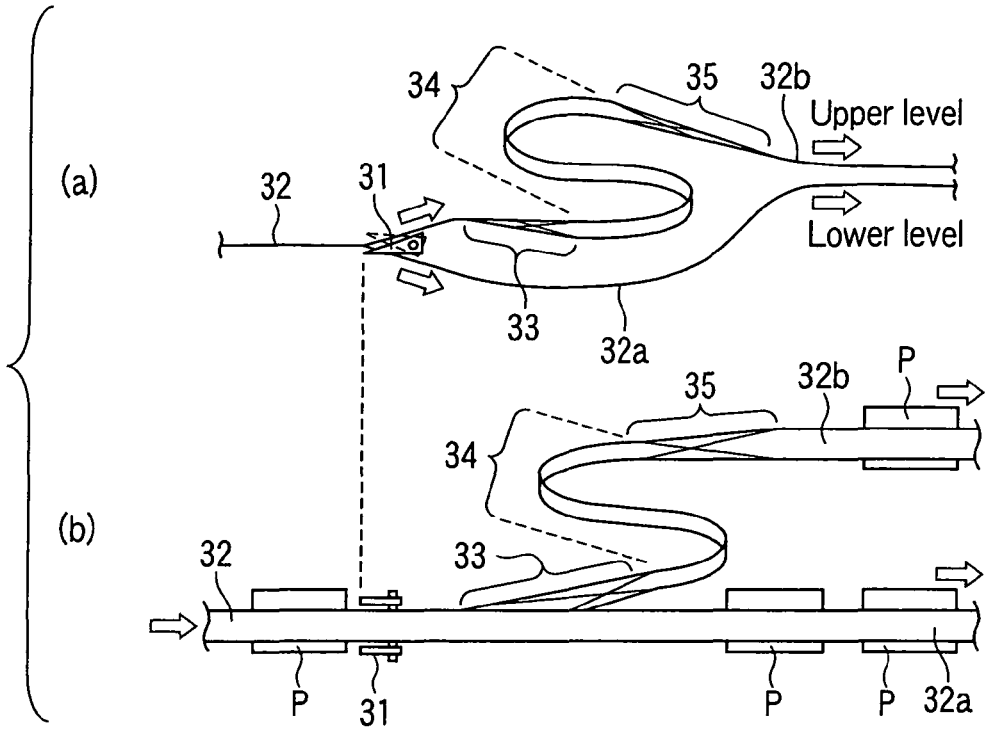
Figure 4:
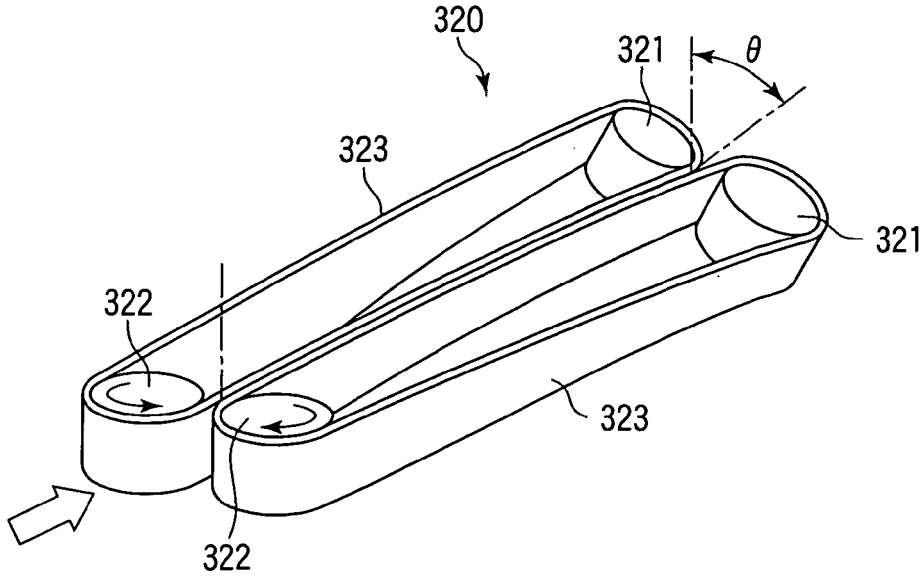
Figure 5:
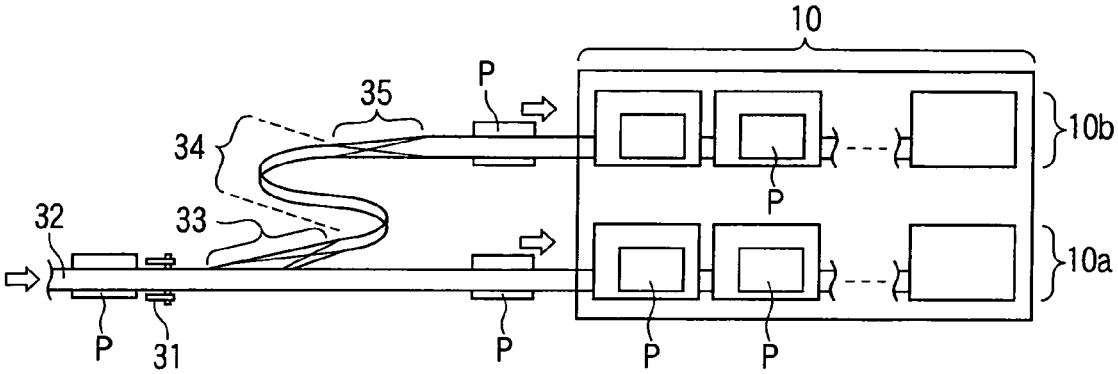

The upper portion (a) of FIG. 3 is a plan view taken when the sorter/conveyor apparatus of FIG. 2 is seen from above;

The lower portion (b) of FIG. 3 is a front view taken when the sorter/conveyor apparatus of FIG. 2 is seen from the front;

FIG. 4 is a perspective view useful in explaining a structure for realizing twisting conveyance; and FIG. 5 is a schematic view useful in explaining an effective use of the sorter/conveyor apparatus of FIG. 2.

DETAILED DESCRIPTION OF THE INVENTION

An embodiment of the invention will be described in detail with reference to the accompanying drawings.

Figure 1:
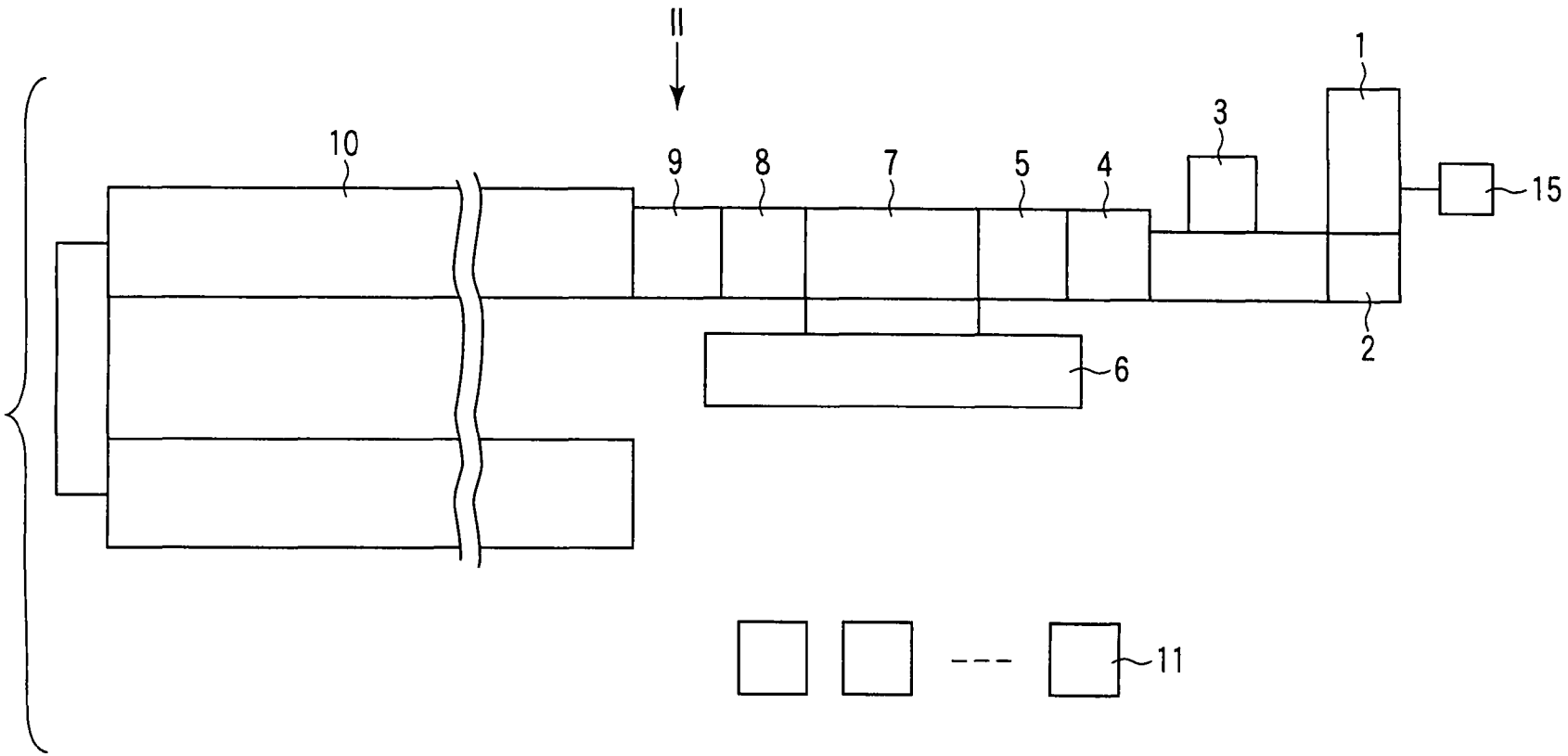
FIG. 1 is a schematic view illustrating the structure of an OCR/VSC integrated system (OVIS) incorporating a sorter/conveyor apparatus according to an embodiment of the invention.

FIG. 1 is a schematic view taken when an OCR/VSC integrated system (OVIS) that incorporates a sheet conveyor apparatus (described later in detail) according to an embodiment of the invention is seen from above. The OVIS processes, as sheets of paper, postal items such as postcards and sealed letters.

Specifically, in the OVIS, an image of each postal item is read, and delivery zone information (hereinafter referred to simply as "zone information") included in the read image is recognized. A barcode indicating the recognized zone information is printed on each postal item by an ink jet printer (IJP), and collected in a stacker corresponding to the zone information.

Further, concerning postal items whose zone information could not be recognized, the image data read therefrom are sent to a video coding system (VCS). In the VCS, an operator performs a keying operation to input a postal code, based on the image data. Based on the input mail code, a barcode corresponding thereto is printed by the IJP during its conveyance, and collected in a corresponding stacker.

More specifically, as shown in FIG. 1, the OVIS comprises a feeder 1, pickup unit 2, excluded-article collector 3, barcode reader 4, character recognition unit 5 (OCR), delayed conveyor unit 6, IJP 7, barcode reader 8, bifurcation section 9 and a group of stackers 10. The OVIS further comprises a plurality of VCSs 11, and a controller 15 for controlling the entire operation of the OVIS.

When an operator manually sets a plurality of postal items in the feeder 1 and the controller 15 starts control, the pickup unit 2 picks up the articles one by one and transfers them to a conveyance path (not shown). At this time, postal items with foreign substances contained therein or having nonstandard sizes are collected into the excluded-article collector 3.

The postal items transferred onto the conveyance path and to be processable are sent to the barcode reader 4, where the barcodes beforehand printed on the postal items are read, and then sent to the character recognition unit 5, where zone information, such as a postal code or address, provided on each postal item is recognized. The postal items passing through the character recognition unit 5 and determined necessary to be subjected to video coding are conveyed to delayed conveyor unit 6.

The delayed conveyor unit 6 is provided to acquire the time required for the plurality of VCSs 11 to perform VCS processing on the postal items whose zone information could not be recognized. Namely, in the VCSs 11, images of the postal items whose zone information could not be recognized are monitored and displayed, and the operator inputs zone information, such as a postal code, by a keying operation within a preset period.

Based on the zone information acquired via the barcode reader 4 and character recognition unit 5, or by VCS processing, a barcode of a particular format is printed on each postal item by the IJP 7. The thus-printed barcode is verified by the barcode reader 8.

Thereafter, the zone destination of each postal item is determined based on its zone information, and each postal item is collected into a stacker corresponding to the determined zone destination. In the embodiment, a plurality of stackers included in the stacker group 10, to which postal items are guided, are arranged such that 152 stackers are arranged in two adjacent lines (upper and lower lines) in the direction of conveyance, i.e., 304 stackers in total are provided, these lines being folded back at their mid-points. At least the most downstream-side stacker of each line is assigned as an overflow stacker (OVF).

Each postal item having its zone destination already determined is delivered to the upper or lower path by a sorter/conveyor apparatus 20 (sheet conveyor apparatus), described later, provided at the bifurcation section 9. Each postal item delivered to each path is collected into a stacker included in the stackers in each path and designated as the zone destination. If there is a postal item that cannot be collected into a designated stacker, it is collected into another stacker assigned, if any, as a multi stacker for the designated stacker, or into the OVF if there is no assigned multi stacker. For instance, if a certain stacker is filled with postal items or the gate of the stacker is out of order, the postal items assigned to this stacker are collected into the OVF.

FIG. 2 is a schematic perspective view illustrating the sorter/conveyor apparatus 20 (hereinafter referred to simply as the "conveyor apparatus 20") provided at the bifurcation section 9. More specifically, FIG. 2 shows the conveyor apparatus 20 seen in the direction indicated by arrow II in FIG. 1. The upper portion (a) of FIG. 3 is a plan view illustrating the conveyor apparatus 20 seen from above, and the lower portion (b) of FIG. 3 is a front view of the conveyor apparatus 20.

In the above-mentioned OVIS, to stabilize the conveyance attitude of each postal item, each postal item is basically conveyed upright in which it is held between a pair of conveyor belts (paired belts) to make its lower edge in contact with a guide surface. Further, in the above-mentioned OVIS, to facilitate the operator's mail-article take-out working, each postal item is collected into a stacker corresponding thereto, kept upright. Accordingly, it is necessary for the conveyor apparatus 20 provided at the bifurcation section 9 to deliver postal items, conveyed upright, to paths of different levels and then into stackers in the stacker group 10 without changing their conveyance attitude.

However, when postal items conveyed upright are delivered to paths of different levels without changing their conveyance attitude, the conveyance attitude becomes unstable, and, at worst, the postal items may jump out of the conveyor belts. In light of this, the inventors of the present invention have contrived to minimize a change in conveyance attitude at the bifurcation section 9 to thereby suppress degradation of the conveyance attitude.

Namely, as shown in FIG. 2, the conveyor apparatus 20 of the embodiment comprises a lower base surface 21 (first reference surface), an upper base surface 23 (third reference surface), and a tilted base surface 22 (second reference surface). The lower base surface 21 is substantially level with the bottoms of the lower-side stackers (not shown) and extends substantially horizontally to convey postal items P upright.

The upper base surface 23 is substantially level with the bottoms of the upper-side stackers (not shown), and extends substantially parallel to and above the right-hand portion (i.e., the downstream-side portion with respect to the conveyance direction of the postal items P) of the lower base surface 21. The tilted base surface 22 is tilted to bridge the lower and upper base surfaces 21 and 23.

Each postal item P is conveyed by the conveyor apparatus 20, basically with its lower edge sequentially brought into contact with the base surfaces 21, 22 and 23 and kept substantially perpendicular to the surfaces (this state indicates the above-mentioned "upright"), whereby the conveyance attitude of each postal item P is twisted twice.

As shown in FIGS. 2, 3A and 3B, a bifurcation gate 31 is provided at the inlet side, i.e., the left-hand side, of the lower base surface 21. The bifurcation gate 31 selectively bifurcates postal items P in two directions. The bifurcation gate 31 is controlled by the controller 15, based on the zone information acquired via the barcode reader 4 and character recognition unit 5, or the zone information acquired by the above-mentioned VCS process. The conveyance direction of each postal item P is selectively switched by the bifurcation gate 31 to be directed to one of the lower-side stackers and upper-side stackers included in the stacker group 10.

Each postal item P is conveyed in accordance with the running of pairs of conveyor belts 32 provided along the conveyance paths, with its both surfaces held between each pair of the belts. The pairs of conveyor belts 32 include pairs of conveyor belts 32*a* and 32*b*. As shown in FIGs. 2 and 3, the pairs of conveyor belts 32*a* are provided along the lower conveyance path extending from the inlet of the bifurcation section 9 via the bifurcation gate 31 to the outlet of the bifurcation section 9 that leads to the stacker group 10. Similarly, the pairs of conveyor belts 32*b* are provided along the upper conveyance path extending between the inlet and outlet of the bifurcation section 9. More specifically, each pair of conveyor belts are endless belts 323, each endless belt 323 being wound on a pair of rollers 321 and 322 and tensioned therebetween as shown in FIG. 4. Each pair of endless belts are arranged to hold each postal item P therebetween. The "pairs of conveyor belts" recited in the claims include pairs of conveyor belts provided in the direction of conveyance of postal items P.

The pairs of conveyor belts 32*a* provided from the bifurcation gate 31 to the lower-side stackers are arranged above and along the lower base surface 21, appropriately curved. The postal items P assigned to the lower-side stackers are conveyed upright by the pairs of conveyor belts 32*a*, with their lower edges kept in contact with the lower base surface 21. Each postal item P thus conveyed with its lower edge kept in contact with the lower base surface 21 can be guided to the stacker group 10 without greatly changing its conveyance attitude.

On the other hand, the pairs of conveyor belts 32*b* provided between the bifurcation gate 31 and the upper-side stackers are intricately twisted and curved at some positions. More specifically, the pairs of conveyor belts 32*b* include a first twisted portion 33, an S-shaped ascending portion 34, and a second twisted portion 35 sequentially formed in this order in the direction of conveyance of postal items P. The first twisted portion 33 is twisted clockwise (or counterclockwise) through a certain angle to thereby tilt each postal item P between the lower base surface 21 and the tilted base surface 22. The S-shaped ascending portion 34 is curved in an S-shape on the tilted base surface 22. The second twisted portion 35 is twisted counterclockwise (or clockwise) through the same angle as the first twisted portion 33, to return each tilted postal item P to its upright state.

The conveyor belts 32*b* located upstream, with respect to the direction of conveyance, of the first twisted portion 33 function as the first conveyor section of the present invention for conveying each postal item P upright with its lower edge kept in contact with the lower base surface 21. The conveyor belts 32*b* corresponding to the first twisted portion 33 and the S-shaped ascending portion 34 function as the second conveyor section of the present invention for tilting each postal item P and conveying the tilted postal item P to the upper conveyance path. The conveyor belts 32*b* corresponding to the second twisted portion 35 and located downstream of the second twisted portion 35 function as the third conveyor section of the present invention for returning the tilted postal item P to the upright state in which the lower edge of the article is kept in contact with the upper base surface 23. Further, the pairs of conveyor belts 32*a* provided downstream of the bifurcation gate 31 along the lower base surface 21 function as the fourth conveyor section of the present invention for conveying each postal item P fed to the bifurcation gate 31, with its attitude kept upright.

FIG. 4 shows only one pair 320 of conveyor belts included in the first twisting portion 33. Each postal item P conveyed held between each pair 320 of belts is clockwise tilted through an angle of θ from the original substantially vertical attitude and sent forth. The tilt angle θ is formed between the rotation axis of each upstream-side roller 322 wound by the corresponding conveyor belt 323, and the rotation axis of the corresponding downstream-side roller 321. In other words, the tilt angle θ of each postal item P coincides with the tilt angle of the tilted base surface 22 with respect to the lower base surface 21.

On the other hand, the second twisted portion 35 extending from the tilted base surface 22 to the upper base surface 23 is counterclockwise twisted through the same angle θ in a manner opposite to the paired conveyor belts 320. The twist angle θ in the first and second twisted portions 33 and 35 is set less than 90°. By thus setting the twist angle θ to an acute angle, the stress occurring in each twisted postal item P can be suppressed, and degradation of its conveyance attitude can be minimized. Further, by setting the twist angle θ small, the disadvantage that the constraint force between the conveyor belts and each postal item P can be prevented from weakening, thereby suppressing slippage therebetween.

The smaller the twist angle θ, the greater reduction of stress. However, if the twist angle θ is too small, the ascending rate of each postal item P in the S-shaped ascending portion 34 is inevitably reduced. Namely, when the twist angle θ is set smaller, it is necessary to set, longer, the total length of the conveyor belts 32*b* of the S-shaped ascending portion 34. Further, in this case, the amount of shift in the horizontal direction after each postal item P is raised to a desired level is increased, it is necessary to correct the horizontal shift. This being so, it is desirable to set the above-mentioned twist angle θ to a relatively large angle less than 90° within a stress allowable range, and also to an appropriate angle determined in light of an appropriate conveyance time and/or conveyance length.

A detailed description will be given of the postal-item conveyance operation of the conveyor apparatus 20 constructed as above.

Firstly, postal items P fed to the conveyor apparatus 20 in the bifurcation section 9 are delivered, under the control of the controller 15, toward the lower- or upper-side stackers in the stacker group 10 via the bifurcation gate 31.

The postal items P fed toward the lower- or upper-side stackers via the bifurcation gate 31 are each held by the conveyor belts 32*a* provided along the lower base surface 21, and are conveyed substantially flat along the lower base surface 21 with their lower edges kept in contact with the lower base surface 21, in accordance with the running of the conveyor belts 32*a*. At this time, the conveyance time and the ejection position, on the base surface, of each postal item P can be adjusted arbitrarily by changing the length and/or curvature of the conveyor belts 32*a*.

On the other hand, the postal items P delivered toward the upper-side stackers via the bifurcation gate 31 are sequentially passed through the first twisted portion 33, S-shaped ascending portion 34 and second twisted portion 35, and conveyed upright toward the upper-side stackers. Although in this embodiment, the postal items P are raised to a higher position via the S-shaped ascending portion 34, they can be conveyed to a lower position by providing the S-shaped belts 32*b* on the lower portion of the tilted surface.

More specifically, each postal item P assigned to the upper path is guided to the first twisted portion 33 in an upright attitude, with its lower edge kept in contact with the lower base surface 21. After passing the first twisted portion 33, each postal item P is clockwise tilted through an angle θ. The tilt angle of each postal item P can be set to an arbitrary value by adjusting the tilt angle of the tilted base surface 22 and the twist angle of the belts incorporated in the first twisted portion 33.

Each postal item P tilted through the angle θ is conveyed through the S-shaped ascending portion 34 that is twice curved, with its lower edge kept in contact with the tilted base surface 22. More specifically, a tilted postal item P is conveyed with its conveyance direction shifted upwardly, and is then curved through substantially 180°. As a result, the tilted postal item P is conveyed in the opposite direction with its upside turned down. After that, the postal item P is conveyed with its conveyance direction shifted upwardly, and is again curved through substantially 180° and guided to the second twisted portion 35.

After passing through the second twisted portion 35, each tilted postal item P is returned into the original upright attitude, and ejected from the conveyor apparatus 20 in an upright attitude in which its lower edge is kept in contact with the upper base surface 23. Also in this case, the ejection position of each postal item P can be adjusted by appropriately curving the conveyor belts 32*b* along the upper base surface 23.

As described above, in the embodiment, since each upright postal item P is tilted by the first twisted portion 33, then raised by the S-shaped ascending portion 34 along the tilted base surface 22, and returned into the upright attitude by the second twisted portion 35, it can be delivered to a desired level without degrading its conveyance attitude. In particular, since each postal item P is conveyed along an S-shaped path in the S-shaped ascending portion 34, it can be efficiently raised using a narrow space, which enables the entire apparatus to be made compact.

Example 1

40000 sheets of a test medium similar to postal items and having different weights and sizes (i.e., different lengths measured along the conveyance path, and different heights measured from the base surface) were prepared and fed to the above-described conveyor apparatus 20. 50% of these sheets were delivered to the upper path and the remaining 50% were delivered to the lower path under the control of the controller 15. At this time, the tilt angle θ of the test medium was set to 40°, the conveyance rate was 3.6 m/s, and the conveyance gap between adjacent test sheets was set to 110 mm. The test sheets had, specifically, weights of 2 to 50 g (average: 25 g), lengths of 135 to 250 mm (average: 210 mm) (measured along the conveyance path), heights of 85 to 170 mm (measured from the guide surface), and thicknesses of 0.15 to 6 mm.

The rate of jamming was 0/05%. The jamming rate was the rate of jammed sheets to the total sheets (40000 sheets in example 1) fed to the conveyor apparatus 20. Namely, under the conditions employed in example 1, 20 sheets included in 40000 sheets were jammed.

Further, the rate of jamming in the conventional conveyance method was measured for comparison. In this method, test sheets conveyed upright were tilted through 90° (i.e., the conveyance attitude was changed flat), then delivered to the upper and lower paths, and returned into the upright attitude. The other conditions were set identical to those in example 1. As a result, the rate of jamming was 0.2%. Namely, 80 test sheets included in 40000 test sheets were jammed.

It is evident from the above result that the rate of jamming can be significantly reduced if the tilt angle of the medium is set smaller than 90°.

Example 2

30% of these sheets were delivered to the upper path and the remaining 70% were delivered to the lower path by the conveyor apparatus 20 with the other conditions unchanged. As a result, the rate of jamming was 0.02%. Namely, only 8 test sheets in 40000 test sheets were jammed.

This means that since postal items P are conveyed, twisted, only when they are delivered to the upper-side stackers of the stacker group 10, the entire jamming rate of the apparatus can be reduced if the rate of deliver to the upper-side stackers, in which the possibility of jamming is relatively strong, is reduced.

Thus, depending upon contrivance as to how to use the conveyor apparatus 20, the rate of jamming can be minimized.

Referring now to FIG. 5, a description will be given of effective use of the OVIS incorporating the above-described conveyor apparatus 20.

The jamming rate can be minimized if the lower-side stackers, in which the possibility of jamming is relatively weak, are normally used, and the upper-side stackers, in which the possibility of jamming is relatively strong, are used as auxiliary ones.

Specifically, upper-side stackers 10*b* are designated as multi-stackers for lower-side stackers 10*a*, or some of the upper-side stackers 10*b* are used as the previously mentioned overflow stackers (OVF), which reduces the rate of conveyance jamming and enables efficient use of the OVIS. Alternatively, if the upper-side stackers are assigned to districts of small populations, to which smaller numbers of postal items P are delivered, the OVIS can also be used efficiently.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

Although in the above embodiment, the conveyor apparatus 20 is used to deliver postal items P to paths of different levels, the invention is not limited to this. The present invention may be applied to sheets of other mediums to be delivered upright to paths of different levels.

Further, the embodiment employs the S-shaped ascending portion 34 for conveying postal items P along an S-shaped path. However, postal items P may be raised linearly or conveyed along a path curved three times or more.

In addition, although in the embodiment, the conveyor apparatus 20 delivers postal items P to the upper- and lower-side paths, the invention is not limited to this. The conveyor apparatus 20 may deliver postal items P to stackers stacked in three or more stages.

What is claimed is:

1. A sheet conveying apparatus for conveying paper sheets to a different level in a direction along surfaces of the paper sheets, comprising:

a first conveyor section configured to convey the paper sheets in an upright orientation along a first path of a first level;

a second conveyor section configured to tilt the paper sheets at an acute tilt angle and convey the tilted paper sheets along a curved conveyance direction to guide and shift the tilted paper sheets to a second path of a second level that is at a different height than the first level;

a third conveyor section configured to restore the tilted paper sheets back to the upright orientation, upon reaching the second level, and convey the upright paper sheets along the second level; and at least one pair of conveyor belts provided along the first to third conveyor sections to hold the paper sheets therebetween and convey the paper sheets, the conveyor belts including a first twisted portion configured to tilt the paper sheets in the second conveyor section, and a second twisted portion configured to return an attitude of the paper sheets to upright in the third conveyor section.

2. The sheet conveying apparatus according to claim 1, further comprising a fourth conveyor section bifurcating from the first conveyor section and configured to convey the paper sheets upright on a third path of the first level.

3. The sheet conveying apparatus according to claim 2, further comprising a controller configured to designate conveyance destinations of the paper sheets to make, high, a rate of paper sheets guided to the fourth conveyor section to paper sheets guided to the second and third conveyor sections.

4. A sheet conveying apparatus comprising:

a first reference surface, a second reference surface, and a third reference surface which are continuously arranged in sequence, wherein the first reference surface is substantially horizontal and configured to keep in contact with lower edges of paper sheets that are conveyed in an upright orientation, the second reference surface has a tilted configuration in which the second reference surface is tilted with respect to the first reference surface along a direction substantially perpendicular to a direction in which the first, second and third reference surfaces are arranged, and the third reference surface is substantially parallel to the first reference surface at a different height from the first reference surface; and at least one pair of conveyor belts extending substantially perpendicular to the first to third reference surfaces, the conveyor belts holding the paper sheets therebetween and permitting the lower edges of the paper sheets to be kept in contact with the first to third reference surfaces while running to convey the paper sheets, the conveyor belts enabling the orientation of the paper sheets to be varied during conveyance thereof, wherein, the tilted configuration of the second reference surface operates to tilt the paper sheets that have an upright orientation from the first reference surface at an acute tilt angle, and then restores the tilted paper sheets back to the upright orientation when the paper sheets are conveyed and shifted to the third reference surface that has a different height than the first reference surface.

5. The sheet conveying apparatus according to claim 4, wherein the conveyor belts include a first twisted portion configured to tilt the paper sheets between the first and second reference surfaces, and a second twisted portion configured to return a conveyance attitude of the paper sheets to upright between the second and third reference surfaces.

* * * * *